United States Patent [19]

Snyder

[11] 4,295,289

[45] Oct. 20, 1981

[54] LASER AIMING DEVICE WITH LATERAL SHOCK ABSORBER

[76] Inventor: Wesley L. Snyder, 1103 Forest Home Dr., Houston, Tex. 77077

[21] Appl. No.: 11,085

[22] Filed: Feb. 12, 1979

Related U.S. Application Data

[63] Continuation-in-part of Ser. No. 949,997, Oct. 10, 1978, Pat. No. 4,168,588, which is a continuation-in-part of Ser. No. 846,691, Oct. 31, 1977, Pat. No. 4,161,076.

[51] Int. Cl.[3] ..... F41G 1/34

[52] U.S. Cl. ..... 42/1 A; 362/113

[58] Field of Search ..... 42/1 A, 1 ST; 362/110–113

[56] References Cited

U.S. PATENT DOCUMENTS

| | | | |
|---|---|---|---|
| 1,452,651 | 4/1923 | Norrlin | 42/1 A |
| 1,535,459 | 4/1925 | Frederickson | 42/1 A |
| 2,510,289 | 6/1950 | Livermore | 42/1 ST |
| 2,597,466 | 5/1952 | Felix | 42/1 ST |
| 2,715,275 | 8/1955 | Kipp | 42/1 ST |
| 2,844,710 | 7/1958 | Zinsser | 42/1 A |
| 3,153,856 | 10/1964 | Felix | 42/1 ST |
| 3,471,932 | 10/1969 | Luning | 42/1 ST |
| 3,867,764 | 2/1975 | Dunmine et al. | 42/1 A |
| 4,026,054 | 5/1977 | Snyder | 42/1 A |
| 4,152,754 | 5/1979 | De Filippis et al. | 42/1 A |
| 4,161,076 | 7/1979 | Snyder | 42/1 A |
| 4,161,835 | 7/1979 | Lough | 42/1 A |
| 4,168,588 | 9/1979 | Snyder | 42/1 A |

FOREIGN PATENT DOCUMENTS

| | | | |
|---|---|---|---|
| 492773 | 4/1919 | France | 42/1 ST |
| 804175 | 7/1936 | France | 89/41 B |
| 401410 | 1/1943 | Italy | 42/1 A |

OTHER PUBLICATIONS

"Scope Your Handgun for Higher Scores", *The American Rifleman,* William F. Krentz, pp. 34–35, Jun. 1974.

*Guns,* "The American 180 New .22 SMG", Clair Rees, pp. 45–47, Dec. 1973.

*Primary Examiner*—Charles T. Jordan

*Attorney, Agent, or Firm*—Arnold, White & Durkee

[57] ABSTRACT

An aiming system for attachment to a weapon has a laser for projecting a beam of light onto a target to assist in aiming the weapon. The aiming system permits the laser to be releasably attached to the firearm by providing a mount which is releasably attached to an adapter secured to the aiming system. To protect the laser from severe recoil shock and to provide a rugged housing which prevents accidental damage or undesirable contaminants from damaging the system, the laser is enclosed within the dustproof housing and connected to a bufer means also carried within the housing. The aiming system further permits easy substitution of interchangeable housings, each enclosing a laser, by providing a mount fixed to the weapon which has a bore sighted adjustment mechanism that serves to adjust the position of the laser with respect to the barrel of the weapon. To prevent damage from lateral impact of the aiming device, a lateral shock absorbing material is provided between the laser tube and the housing.

18 Claims, 12 Drawing Figures

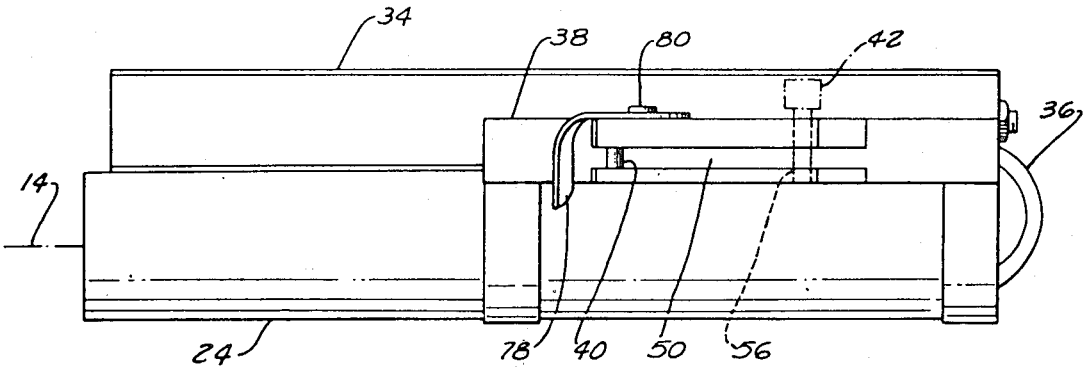
FIG. 4
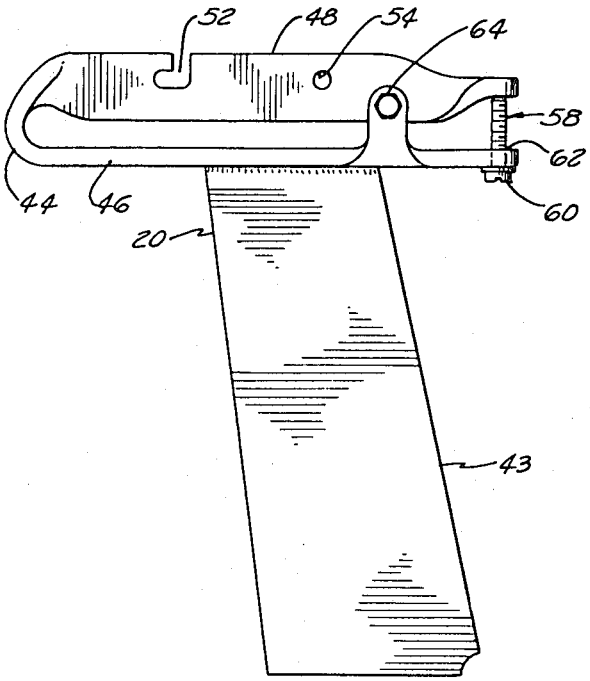
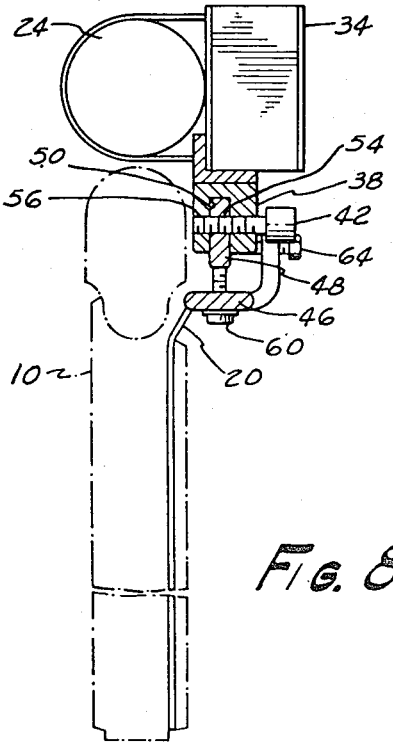
FIG. 8
FIG. 5

LASER AIMING DEVICE WITH LATERAL SHOCK ABSORBER

CROSS REFERENCE TO RELATED APPLICATION

This application is a continuation-in-part application of U.S. Ser. No 949,997, Filed Oct. 10, 1978, now U.S. Pat. No. 4,168,588 which is a continuation-in-part of U.S. Patent Application Ser. No. 846,691, filed Oct. 31, 1977 now U.S. Pat. No. 4,161,076.

BACKGROUND OF THE INVENTION

Field of the Invention

This invention relates generally to an aiming system for attachment to a weapon, and more particularly to an aiming apparatus having a light projection aiming device, and which is supported by a cushioned housing providing maximum protection during use.

It is well known in the art to attach a light projection device, particularly a laser, to a weapon to assist in aiming the firearm at a target. The advantages provided by such an aiming system, especially at night, are well acknowledged. However, the need for an accurate aiming system which is completely self-contained and able to operate effectively under severe environmental conditions as well as withstand recoil shock is great. For example, law enforcement personnel are often called upon to utilize such aiming devices in combination with selected weapons under conditions which are not conducive to the use of delicate or easily damaged instruments. Such use often requires that the aiming device be exposed to severe weather and other conditions resulting in water, dust or other types of contaminants being deposited on or around the aiming system. Such contaminants often prevent proper functioning of the aiming device at very critical times. Therefore, such devices must be made dependable under any operating conditions.

The need for laser-sighted aiming systems may not always be present. Therefore, it is desirable to provide sighting apparatus having a mount and adapter assembly that permits a laser aiming system to be placed on or removed from a weapon very quickly and easily. Also, in case failure of one laser aiming device occurs, it is desirable to have a mount that permits substitution of portions of the aiming device without resighting of the aiming device with respect to the barrel of the firearm.

A description of much of the prior art relating to laser-sighted weapons is presented in U.S. Pat. No. 4,026,054. Much of the prior art disclosed therein points out that many systems have been developed utilizing varying types of shock absorbing means connected to a telescope mount or other aiming system. Also, in U.S. Pat. No. 4,026,054, a pneumatic buffering system is disclosed utilizing a piston disposed within a fixed cylinder to absorb the shock upon recoil.

Reference is also made to U.S. Pat. No. 4,079,534, for a mount to be used with a sighting system for firearms.

Although the prior art discloses sighting systems utilizing a laser mounted onto a weapon, there is not provided a sighting system which combines an aiming device fully protected from recoil shock and environmental damage which can be quickly and easily removed from the weapon without the necessity of resighting or realigning the aiming system with respect to the barrel of the weapon at a predetermined target range.

Further, the prior art aiming systems have the major disadvantage of laser tube damage resulting from lateral impact, as from a free fall of the device.

SUMMARY OF THE INVENTION

In accordance with the instant invention, there is provided an aiming system for attachment to a weapon having a dust-proof housing which is secured in a fixed relation to a mount rigidly attached to the weapon. A laser is enclosed within this dust-proof housing, the laser being capable of projecting a coherent beam of light onto the target. A buffer is enclosed within the dust-proof housing and interposed between the housing and the laser, this buffer cushioning the laser from shock upon recoil and other damages from external blows.

The present invention further provides a shock absorbing material to protect the laser from damage due to lateral impact. The shock absorbing material may be disposed between the laser tube and the sheath member and may comprise a foam cushion material of either a lock cell or open cell type.

The instant invention further provides that the buffer includes a bushing secured to the laser and adapted for maintaining the laser in a central location within the dust-proof housing while allowing limited longitudinal movement of the laser upon shock from recoil. The buffer may also include a resilient member adapted for engaging the bushing and yieldably resisting longitudinal movement of the laser and urge the laser into an intermediate position after shock has been absorbed.

The instant invention further provides an aiming system that includes a trigger mechanism attached to a releasable adapter assembly and positioned adjacent the trigger of the weapon thereby enabling efficient activation of the system.

In accordance with this invention and to achieve the above features, there is provided an aiming system for attachment to a weapon having an elongate barrel which comprises a dust-proof housing member. A mount is fixed to the weapon and is releasably connected to the housing. The mount also includes a windage and an elevation adjustment mechanism for sighting-in the system at a predetermined target range. A sheath member is positioned within the dust-proof housing and contains a laser, the laser being capable of projecting a coherent beam of light onto the target. A bushing is attached to the sheath for axially locating the sheath within the housing. The bushing is adapted for slidably engaging the housing. A coiled spring is also enclosed within the dust-proof housing and engages the bushing to yieldably resist longitudinal movement of the sheath within the housing. The coil spring also urges the sheath to an intermediate position centrally located within the housing after absorption of recoil shock. A trigger mechanism is pivotally attached to the system and positioned adjacent the trigger of the weapon. This positioning allows activation of the laser in conjunction with firing of the weapon.

This invention, although especially suitable for use with a pistol type weapon, is also useful with other types of firearms such as rifles and shotguns. Other aspects of this invention not outlined above will be disclosed from the detailed description presented below.

In accordance with the present invention, a Brewster window lens is provided to protect a laser, secured in a carrying member, from the environment and further optimize the range of the laser beam. The member carrying the laser may also include a power supply electrically connected to the laser for activation purposes and may further include a magnetic safety switch for controlling the activation of the laser.

The present invention also provides for coaction between the buffer and the shock absorber. Upon impact of the laser carrying member the shock absorber will dampen lateral shock while the buffer will return the laser to its initial position within the carrying member. This interaction prevents shock absorber wear due to continued support of the laser after impact.

BRIEF DESCRIPTION OF DRAWINGS

A more complete appreciation of the invention may be had by reference to the accompanying drawings, illustrating the preferred embodiment of the invention to be described in detail, in which like reference numerals designate identical or corresponding parts throughout the several views and wherein:

FIG. 4 is a view of the underside of the sighting system shown in FIG. 3;

FIG. 5 is a view of the mount portion of the aiming system that attaches to the firearm and engages an adapter assembly connected to the laser housing and power supply.

FIG. 8 is a frontal section view of the system attached to the weapon illustrated in FIG. 2;

DETAILED DESCRIPTION OF A PREFERRED EMBODIMENT OF THE INVENTION

Figure 1:
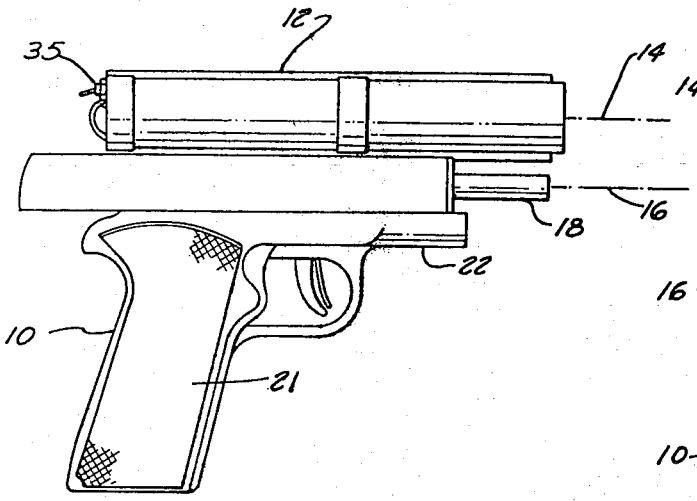
FIG. 1 is a side view of a weapon having an aiming system in accordance with the present invention attached thereon.

Referring now to the drawings, and more particularly to FIG. 1 thereof, there is shown weapon 10, an automatic pistol, having aiming system 12 attached thereto. Aiming system 12 projects a beam 14 of coherent light that is aligned to coincide with the bore axis 16 of elongate barrel 18 of the weapon 10 at some predetermined distance from weapon 10. As will be appreciated, the present invention, one embodiment of which is shown in the various drawings, is adaptable for use with any type of weapon such as a pistol, rifle or shotgun; although, discussion of this embodiment will be principally with regard to its attachment to a pistol.

Figure 2:
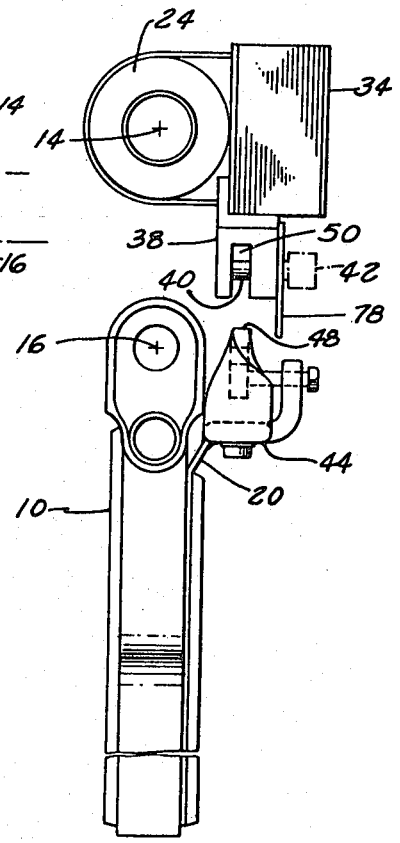
FIG. 2 is a frontal view of the weapon in FIG. 1 showing the aiming system adjacent the weapon and in position for attachment to the weapon.

In the illustrated embodiment of FIGS. 1 and 2, aiming system 12 is disposed on the top and alongside weapon 10 and is releasably secured thereto by mount 20. Although mount 20 is shown to be secured to weapon 10 at the grip portion 21 thereof, the mount may be of such a configuration as to be attached in any number of ways, including mounted to body portion 22 of weapon 10. However, it should be determined by the ease of handling of the weapon and the overall balance of the weapon and system together as to prevent difficulty in aiming the device.

Figure 6:
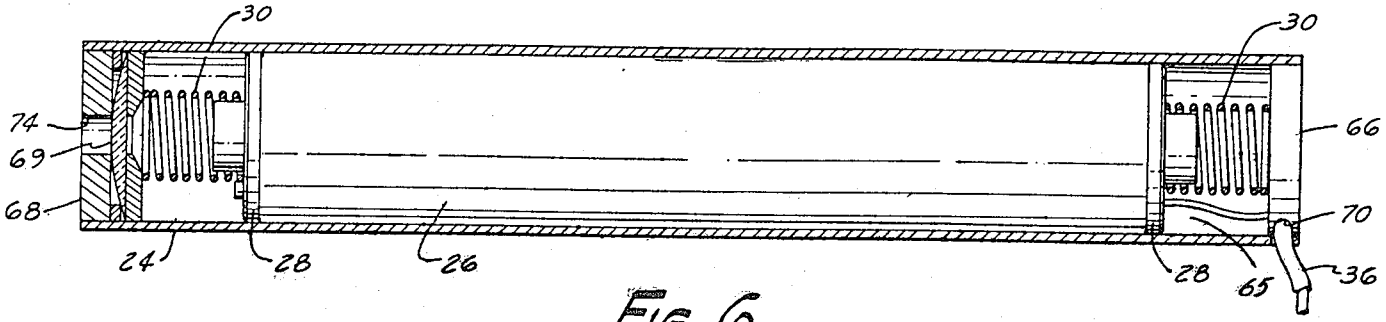
FIG. 6 is a partial sectional plan view of the dust-proof housing, sheath member and buffering means carried therein.

In FIGS. 2 and 6, additional details of the aiming system 12 are presented, especially dust-proof housing 24 containing sheath member 26, bushing 28 and resilient means in the form of spring 30. Even though housing 26 is referred to as "dust-proof", it is to be understood that this term is meant to include the ability to keep out other contaminants such as water, soil or mud. A light emitting device in the form of laser 32 is shown in sectional FIG. 7 enclosed within sheath 26, this laser beam, for example and without limitation, being the helium-neon type laser.

Returning now to FIGS. 2 and 3, dust-proof housing 24 is shown rigidly attached to weapon 10 and to a power supply 34, supply 34 providing power sufficient to activate laser 32 through electrical conductors 36. Conductors 36 extend from power supply 34 to the rear of dust-proof housing 24. (See FIG. 4). Supply 34 also carries an on/off indicator lamp 33 and on/off master toggle switch 35. Supply 34 is carried as a portion of the aiming system 12 and is also rigidly mounted to weapon 10 by means of adapter assembly 38. Adapter assembly 38 is releasably attached to mount 20 by pin 40 and set screw 42, such operation being more fully discussed subsequently.

As illustrated in FIGS. 4 and 5, the releasable feature of the invention can best be described. Mount 20 includes handle portion 43 which is adapted for attachment to the handle grip portion 21 of the pistol. However, it will be appreciated that handle portion 43 could be configured in any shape desirable in order to affect securement of mount 20 in any number of ways to weapon 10. For example, portion 43 could be configured in the shape of a clamp which would attach to the barrel or stock portion of weapon 10.

The upper portion of mount 20 consists of unitary, flat member 44 having a lower base portion 46 which is bent back upon itself approximately 180° and also twisted approximately 90° to form a vertical upper rail portion 48. Rail portion 48 is spaced from weapon 10 (see FIG. 8) and adapted for receiving adapter assembly 38.

Adapter assembly 38 contains a longitudinal groove or channel 50 sized such as to permit rail portion 48 to be fitted within groove 50 thereby enabling adaptor assembly 38 to straddle rail portion 48 of mount 20 when the system is attached to weapon 10. As can be easily understood, when aiming system 12 is to be attached to weapon 10, pin 40, which is fixed within groove 50, is first positioned in slot 52 located in rail portion 48. Adapter assembly 38, which is rigidly attached to housing 24 and supply 34, is then rotated about pin 40 until the central part of rail portion 48 is fitted into groove 50. When properly aligned, aperture 54 of rail portion 48 coincides with threaded port 56 located in adapter assembly 38 allowing set screw 42 to be inserted through aperture 54 and threaded into port 56. (See FIG. 8). Thereby, adapter assembly 38 is rigidly secured to mount 20 and weapon 10. Removal of the aiming system is easily accomplished by removing set screw 42 and rotating adapter assembly 38 until pin 40 can be removed from slot 52.

Referring again to FIGS. 5 and 8, a windage and an elevation adjustment mechanism are presented. Such mechanisms are needed to adjust the horizontal and vertical alignment of the laser with respect to the barrel of the weapon or accommodate changes in target range and conditions. Vertical or elevation adjustment mechanism 58 includes screw 60 threaded through hole 62 within lower base portion 46, screw 60 having one end engaging rail portion 48.

As can be understood from FIG. 5, the angular orientation of rail portion 48 in a substantially vertical plane with respect to weapon 10 can be altered by simply rotating screw 60. Such rotation causes one end portion of rail 48 to move upward while the opposed end remains substantially stationary; thereby allowing the elevation of the aiming system to be altered without complicated and time-consuming adjustments. Also, once the system has been correctly aligned, replacement portions possibly consisting of housing 24, supply 34, and adapter assembly 38 can be quickly and easily installed without the necessity of readjusting the elevation or windage since the mechanism is an integral part of mount 20, mount 20 remaining with weapon 10 at all times.

As also seen in FIG. 5, windage or horizontal adjustment is accomplished by rotating threaded pivot screw 64 which also is threaded through rail portion 48. Thus, the alter the horizontal alignment of laser 32 with respect to the bore of the weapon, it is simply necessary to rotate pivot screw 64 thereby moving one end part of rail portion 48 in a horizontal plane closer to or away from the body of the weapon while the opposed end of rail portion 48 remains substantially stationary at a predetermined distance from weapon 10.

Figure 7:
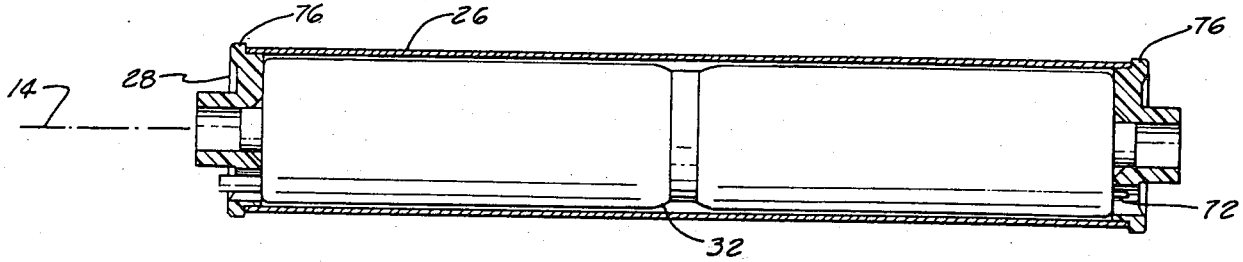
FIG. 7 is a sectional plan view of the sheath member and bushing carried in the housing member.

The ability of the present invention to buffer the delicate laser 32 from damage due to shock upon recoil of the weapon while also providing a rugged dust-proof housing for such buffering mechanisms and laser and thereby greatly improving efficient operation of the system, is presented in detail in FIGS. 6 and 7. Housing 24 encloses laser 32 within internal chamber 65, housing 24 being made dust-proof by use of end plate 66, head mechanism 68 and lens 69. End plate 66 has opening 70 through which electrical conductor 36 passes and is connected to laser 32 at terminal 72. Head mechanism 68 contains opening 74 through which the coherent beam of light produced by laser 32 passes. Lens 69 is positioned adjacent head mechanism 68 with a seal means provided between mechanism 68 and lens 69. In the embodiment shown, lens 69 takes the form of a simple watch crystal type lens. Such a lens is used to limit the range of the laser by diffusing the light such that the device may not be used for long range weapons. It is also noted that other lens arrangements are available and easily adaptable to facilitate various range intervals.

Within internal chamber 64 of housing 24 are buffering means and laser 32. This buffering means is positioned such that it cushions laser 32 from shock upon recoil of the weapon 10. This cushioning is accomplished by the use of at least one bushing 28 adapted for maintaining a spaced relationship between the internal surface of housing 24 and laser 32 while allowing limited longitudinal movement of laser 32 relative to housing 24. Also, at least one resilient means, for example, coiled spring 30, engages bushing 28 to yieldably resist longitudinal movement of laser 32 within housing 24 and upon such movement resulting from recoil, urging laser 32 to an intermediate position within the housing.

As more particularly shown in FIGS. 6 and 7, housing 24 completely encloses laser 32 and the buffering means. In the embodiment shown, laser 32 is snuggly fitted into circular sheath 26, with circular bushing 28 partially inserted into each end of sheath 26. As more clearly seen in FIG. 7, bushings 28 are formed such that each bushing has a maximum outside diameter slightly larger than the outside diameter of circular sheath 26, thereby forming circumferential lip portion 76.

Also, the maximum outside diameter of bushing 28 is slightly less than the internal diameter of housing 24 such that sheath 26, with bushing 28 attached, may be completely inserted into housing 24. As seen in FIG. 6, upon insertion into housing 24 of sheath 26 with laser 32 inside, lip portions 76 slidably engages the internal surface of housing 24. Thus, sheath 26 and enclosed laser 32 may move in a longitudinal direction within housing 24 upon recoil of weapon 10. Since lip portion 76 extends slightly beyond the external surface of sheath 26, sheath 26 does not contact the internal surface of housing 24, as illustrated in FIG. 6. Thus, only lip portion 76 of bushings 28 contact housing 24 thereby providing sufficient support for sheath 26 without excessive frictional engagement between the external surface of sheath 26 and the internal surface of housing 24. As can be appreciated, bushings 28 may be formed from any suitable material adapted for withstanding such sliding engagement minimizing friction, as for example, nylon or a TEFLON coated material.

However, it is advantageous to provide resilient means to yieldably resist longitudinal movement of laser 32 and restore it to an intermediate position after the recoil energy has been absorbed by the buffering means. The embodiment of FIG. 6 illustrates these resilient means to be, for example and without limitation, coiled springs 30 engaging bushings 28 and corresponding end plate 66 or lens 69.

As can be appreciated, bushings 28 may be replaced by a single bushing centrally located along the length of sheath 26 wherein springs 30 encircle a portion of sheath 26 to control such a single bushing.

It is also pointed out that sheath 26 may be replaced by one or more bushings 28 adapted for direct attachment to laser 32, as for example cup-shaped bushings which form captype enclosures for each end of laser 32.

Figure 3:
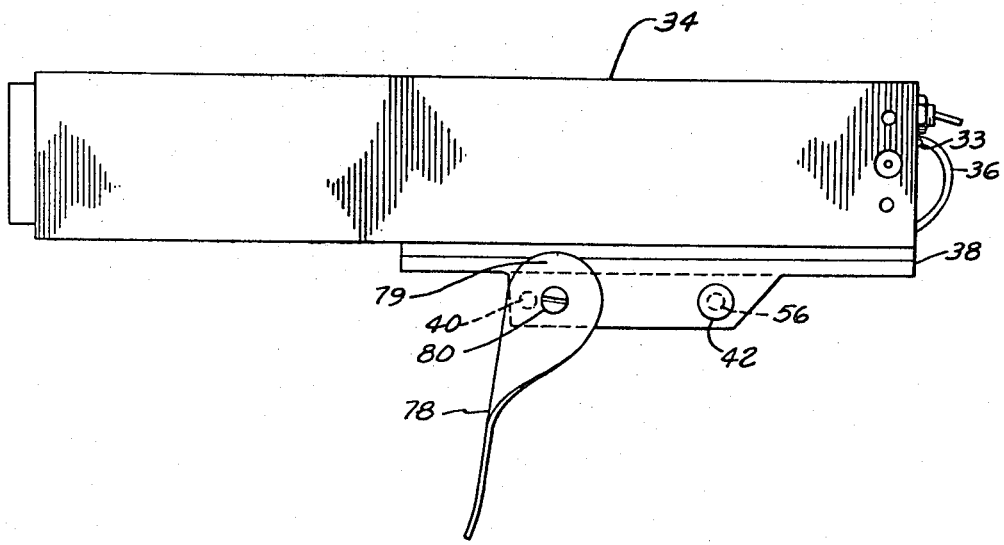
FIG. 3 is a side view of the aiming system of the present invention illustrated in FIG. 1.

The present aiming system also includes a trigger mechanism 78 having tab portion 79 shown in FIGS. 3 and 4 which is pivotally attached to a portion of adapter assembly 38 by pin 80. Tab portion 79 is adapted to actuate laser 32 when trigger mechanism 78 is rotated a predetermined amount about pin 80. Mechanism 78 is positioned adjacent the trigger of weapon 10 whereby mechanism 78 is rotated by the finger of the operator prior to engaging the trigger of weapon 10 (see FIG. 1). Such positioning allows the operator to actuate laser 32 and position the projected light beam on target and subsequently fire the weapon by simply continuing the movement of the same finger which has activated laser 32.

Figure 9:
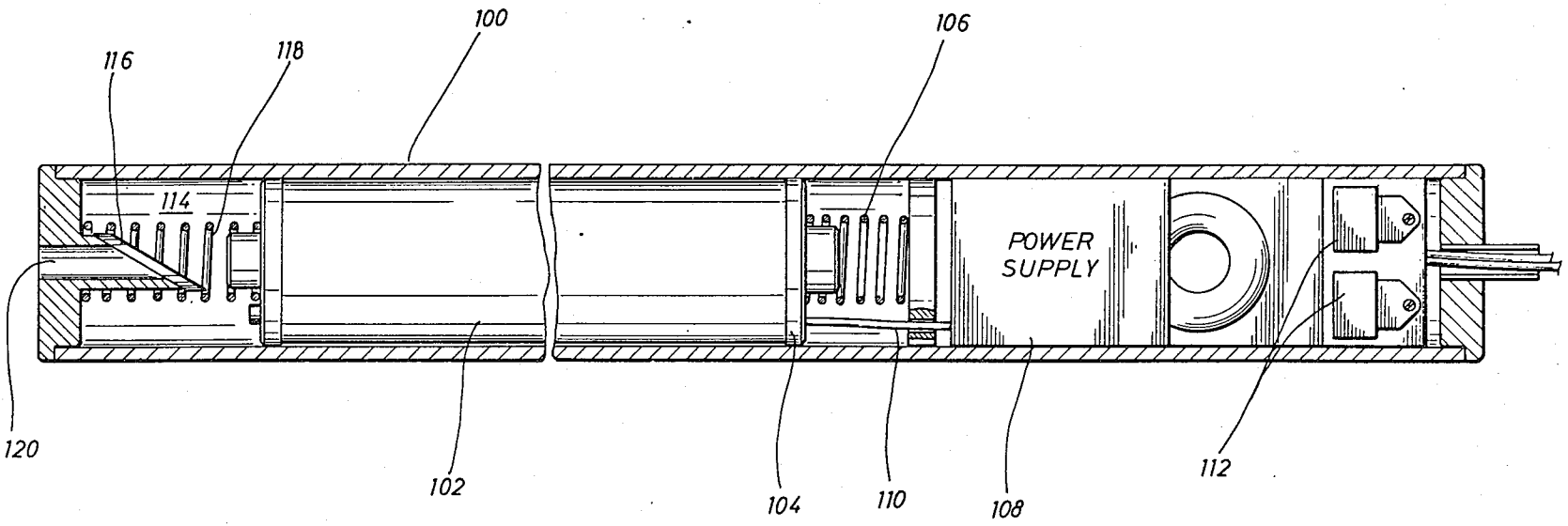
FIG. 9 is a cutaway side view of the carrying member for a laser including a Brewster window lens, a power supply electrically connected to the laser, and a magnetic safety switch electrically connected to the power supply.

FIG. 9 demonstrates that the member 100 carrying the laser 102 may be extended beyond the means for controlling longitudinal movement, that is, beyond bushing 104 connected to the spring 106. This extension of housing 100 enables the placement of a power supply 108 within the housing 100 to be electrically connected by way of connector 110 to the laser 102. Having the power supply 108 within the member 100 not only provides for efficiency in activating the laser 102 but also provides a safety factor in that the conductor 110 is also enclosed and will not come in contact with the user of a weapon having such a laser aiming system.

A magnetic safety switch 112 may also be enclosed within the member 100. The addition of the magnetic safety switch 112 also provides a significant safety feature on the laser aiming device as illustrated in FIG. 8; since the activation of the laser 102 is controlled by an additional switching mechanism.

The magnetic safety switch may include a rotating disk having a magnet disposed therein in adjacent relationship to a reed switch (not shown). When the magnet approaches the reed switch it activates the switch electrically connecting the power supply to the laser.

The simple watch crystal lens illustrated in FIG. 6 and described hereinabove may be replaced by a Brewster window lens 114 which protects the laser 102 from the movement and further optimizes transmission of the laser beam. A Brewster window is a special glass window used at the end of a laser to transmit the laser output while reflecting other light. The Brewster window lens provides an optical lens 116 located within a spring coil 118 and adjusted at a Brewster angle. A Brewster angle may be defined as the angle of incidence for which a wave polarized parallel to the plane of incidence is wholly transmitted with no reflection. The optical lens 116 is located so as to seal the opening 120 in the member 100, making the member 100 dust-proof and moisture proof.

Figure 10:
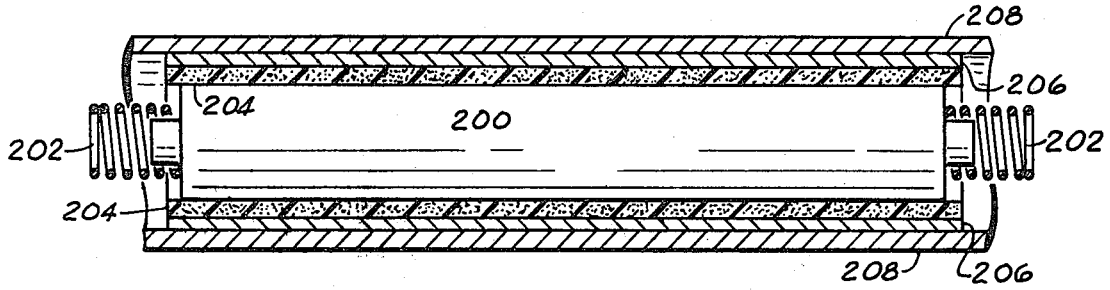
FIG. 10 is a cutaway view of the carrying member for a laser, including a lateral shock absorber in accordance with the principle of the present invention.

Referring now to FIG. 10 a plasma or laser tube 200 is provided with longitudinal buffers 202 and lateral shock absorber 204. The longitudinal buffers 202, or compression springs, perform the dual function of absorbing shock from a vertical impact of the laser tube 200 and further providing a mechanism for returning the laser tube 200 to its initial position after recoil of a weapon. The shock absorber 204 is comprised of a shock absorbing material which preferably is a standard packing foam having either an open cell or lock cell density type. The lateral shock absorber 204 surrounds the laser tube 200 and may be held in place by a sheath 206 or by the laser carrying member 208. Alternatively, the shock absorbing material may be bonded to the tube 200 or to the member 208. Further, the sheath 206 may be affixed to the lateral shock absorber 204 so as to have a one piece unit sliding within the outer housing 208.

The foam used to fabricate the lateral shock absorber 204 preferably is of the type manufactured by Dow Chemical Company or Phillips Oil Company and in the illustrated embodiment is a layer of foam 1/16", thus giving $\frac{1}{8}$" lateral movement. The width of the lateral shock absorber 204 depends on the size of the laser tube 200 and the degree of protection desired.

Although 1/16" of foam is preferred, the range of thickness is from zero giving no protection to the thickness allowed by the contraint of the outside diameter of the housing. Further, using lock cell foam having the characteristic of entrapped gas or air causing added strength or hardness allows thinner layers of material. However, open cell foam due to its crushing tendencies requires thicker layers and thus a greater area between the laser tube and support member.

Figure 11A:
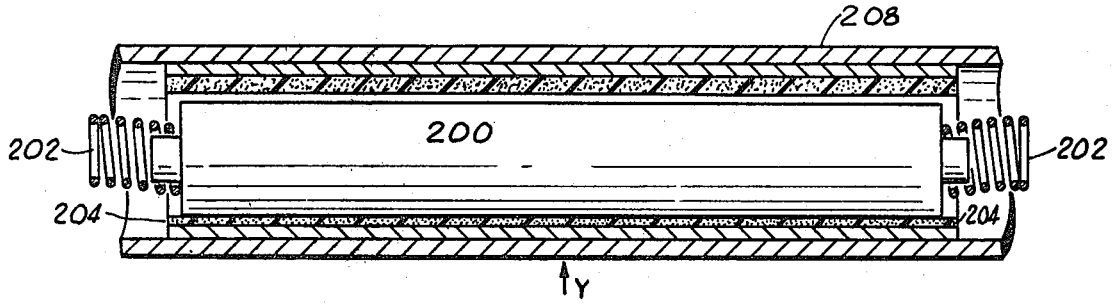
FIGS. 11A and 11B are schematic illustrations of examples of the movement of the laser tube within the carrying member upon lateral impact.
Figure 11B:
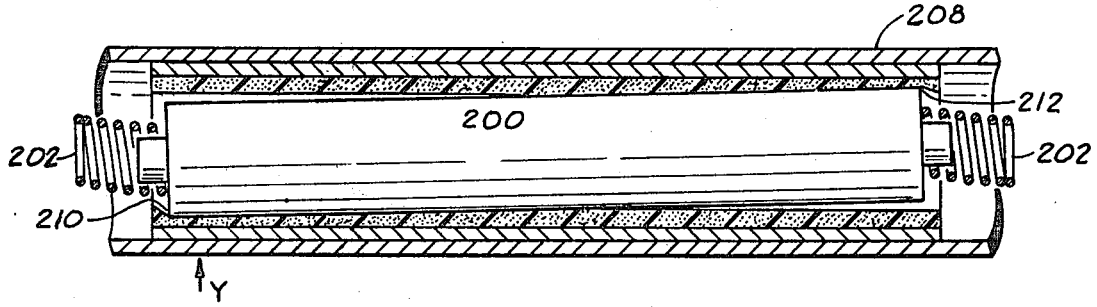

FIGS. 11A and 11B demonstrate two examples of the operation of the lateral shock absorber 204 upon impact. Referring to FIG. 11A, assuming the impact point Y is located substantially in the center of the aiming device, the laser tube 200 will deflect laterally within the housing 208, potentially damaging the tube. The lateral shock absorber 204, however, prevents the laser tube 200 from receiving the full shock of the impact. Further, the compression springs or longitudinal buffers 202 immediately upon impact begin to return the laser tube 200 to its initial position. Thus, the longitudinal buffers 202 assist in the lateral protection, and further prevent the lateral shock absorber 204 from having to support the laser tube 200 for a sustained length of time. The continuous support of the weight of laser tube 200 would cause the lateral shock absorber 204 to lose its elastic qualities.

FIG. 11B is a second example of the operation of the lateral shock absorber 204 upon impact of the carrying member 208. When the impact point Y is moved forward of center, the laser tube 200 displays a pivoting action, forcing one end 210 of the laser tube 200 in a downward motion toward the point of impact and the other end 212 of the laser tube in an upward motion away from the plane of the impact point. The lateral shock absorber 204 will shield the laser tube 200, moving in both directions, and the longitudinal buffer 202 will accordingly return the laser tube 200 to its initial position within the housing 208. In the examples shown in FIGS. 11A and 11B the shock encountered from the impact is absorbed in the shock absorber 204 and transmitted into the positioning springs which further dampens the effects of the lateral impact.

The utilization of the lateral shock absorbers 204 demonstrated in examples of FIGS. 11A and 11B enable 360° freedom of movement of the laser tube 200 within the carrying member 208.

The foregoing description of the instant invention has been directed to a particular preferred embodiment of the present invention for purposes of explanation and illustration. It will be apparent, however, to those skilled in this art, that many modifications and changes in the apparatus may be made without departing from the scope and spirit of the invention. It is therefore intended that the following claims cover all equivalent modifications and variations as fall within the scope of the invention as defined by the claims.

What is claimed is:

1. An aiming device for attachment to a barrelled weapon comprising:

a light source for projecting a coherent beam of light onto a target;

a member securable to the weapon for carrying said light source such that the beam is directed along the barrel of the weapon, said member defining an internal surface;

a longitudinal buffer supported by said member and interposed between said light source and said internal surface for cushioning said light source from shock upon recoil of said weapon; and shock absorbing materials disposed laterally of said light source for preventing damage to said light source due to lateral impact.

2. An aiming device as set forth in claim 1 wherein said light source comprises a plasma tube.

3. An aiming device as set forth in claim 1 wherein said member is a dust-proof housing which totally encloses said light source, said buffer, and said shock absorbing material.

4. An aiming device as set forth in claim 1 further including a sheath member for enclosing said light source and said shock absorbing material, said sheath member slidably engaging said internal surface.

5. An aiming device as set forth in claim 1 wherein said shock absorbing material comprises a layer of open cell foam.

6. An aiming device as set forth in claim 1 wherein said shock absorbing material comprises a layer of lock cell foam.

7. An aiming device as set forth in claim 4 wherein said sheath member is attached to said shock absorbing material, and said shock absorbing material is attached to said light source, facilitating longitudinal movement of said light source within said member.

8. An aiming device for attachment to a barrelled weapon comprising:

a light source for projecting a coherent beam of light onto a target;

a member securable to the weapon for carrying said light source such that the beam is directed along the barrel of said weapon, said member defining an internal surface;

shock absorbing material disposed laterally of said light source, for preventing damage to said light source due to lateral impact; and a longitudinal buffer, supported by said member and interposed between said light source and said internal surface, and operatively associated with said shock absorbing material for returning said light source to an intermediate position within said member upon lateral impact.

9. An aiming device as set forth in claim 8 wherein said longitudinal buffer comprises compression springs disposed between said internal surface and said light source.

10. An aiming device for attachment to a barrelled weapon comprising:

a light source for projecting a coherent beam of light onto a target;

a member securable to the weapon for carrying said light source such that the beam is directed along the barrel of the weapon, said member defining an internal surface;

shock absorbing material, disposed laterally of said light source, for preventing damage to said light source due to lateral impact; and said light source independently suspended within said member such that lateral shock is received through said shock absorbing material.

11. An aiming device as set forth in claim 10 where in said light source comprises a plasma tube.

12. An aiming device as set forth in claim 10 wherein said member is a dustproof housing which totally encloses said light source, and said shock absorbing material.

13. An aiming device as set forth in claim 10 further including a sheath member for enclosing said light source and said shock absorbing material, said sheath member slideably engaging said internal surface.

14. An aiming device as set forth in claim 10 wherein said shock absorbing material comprise a layer of open cell foam.

15. An aiming device as set forth in claim 10 wherein said shock absorbing material comprise a layer of lock cell foam.

16. An aiming device as set forth in claim 13 wherein said sheath is attached to said shock absorbing material, and said shock absorbing material is attached to said light source, facilitating longitudinal movement of said light source within said member.

17. An aiming device for attachment to a barrelled weapon comprising:

a light source for projecting a coherent beam of light onto a target;

a member securable to the weapon for carrying said light source such that the beam is directed along the barrel of the weapon, said member defining an internal surface; and cellular shock absorbing material disposed laterally of said light source, for preventing damage to said light source due to lateral impact.

18. An aiming system for attachment to a barrelled weapon comprising:

a light source for projecting a coherent beam of light onto a target;

a member securable to the weapon for carrying said light source such that the beam is directed along the barrel of the weapon, said member defining an internal surface;

material, disposed laterally of said light source, of a shock absorbing nature suitable for preventing damage to said light source due to lateral impact; and said light source independently suspended within said member such that lateral shock is received through said shock absorbing material.

* * * * *

UNITED STATES PATENT AND TRADEMARK OFFICE

CERTIFICATE OF CORRECTION

PATENT NO. : 4,295,289

DATED : October 20, 1981

INVENTOR(S) : Wesley L. Snyder

It is certified that error appears in the above—identified patent and that said Letters Patent is hereby corrected as shown below:

Column 3, line 37, change "." to --;--.
Column 5, line 34, change first occurrence of "the" to --to--.
Column 6, line 52, change "captype" to --cap-type--.
Column 7, line 25, change "movement" to --environment--;
line 64, change "contraint" to --constraint--.
Column 9, line 4, change "material." to --materials.--;
line 7, change "material," to --máterials,--;
line 10, change "material" to --materials-- and change "comprises" to --comprise--;
line 13, change "material" to --materials-- and change "comprises" to --comprise--;
line 17, change "material," (first occurrence) to --materials,--; change "material" (second occurrence) to --materials--; and change "is" to --are--.
Column 10, line 4, change "where in" to --wherein--;
line 15, change "comprise" to --comprises--;
line 18, change "comprise" to --comprises--.

Signed and Sealed this

*Thirteenth* Day of *April 1982*

[SEAL]

*Attest:*

GERALD J. MOSSINGHOFF

*Attesting Officer*

*Commissioner of Patents and Trademarks*